US007556022B1

(12) United States Patent
Doherty et al.

(10) Patent No.: US 7,556,022 B1
(45) Date of Patent: Jul. 7, 2009

(54) ATTACHMENT FOR FUEL INJECTORS IN DIRECT INJECTION FUEL SYSTEMS

(75) Inventors: Robert Doherty, Syracuse, IN (US); Michael J. Zdroik, Metamora, MI (US)

(73) Assignee: Millennium Industries, Auburn Hills, MI (US)

( * ) Notice: Subject to any disclaimer, the term of this patent is extended or adjusted under 35 U.S.C. 154(b) by 0 days.

(21) Appl. No.: 11/969,656

(22) Filed: Jan. 4, 2008

(51) Int. Cl.
*F02M 61/14* (2006.01)
*F02M 61/18* (2006.01)

(52) U.S. Cl. ..... 123/470; 123/456

(58) Field of Classification Search ..... 123/470, 123/468, 469, 456, 466, 198 D; 239/600
See application file for complete search history.

(56) References Cited

U.S. PATENT DOCUMENTS

| | | | | |
|---|---|---|---|---|
| 134,158 | A | 12/1872 | Nutting | |
| 4,474,160 | A | 10/1984 | Gartner | |
| 4,929,002 | A | 5/1990 | Sauer | |
| 4,993,390 | A | 2/1991 | Ono | |
| 5,167,213 | A | 12/1992 | Basler | |
| 5,301,647 | A | 4/1994 | Lorraine | |
| 5,520,151 | A | 5/1996 | Gras | |
| 5,803,052 | A | 9/1998 | Lorraine | |
| 6,019,089 | A | 2/2000 | Taylor | |
| 6,382,187 | B1 | 5/2002 | Scollard | |
| 6,418,912 | B1 * | 7/2002 | Lorraine | 123/470 |
| 6,457,456 | B1 | 10/2002 | Scollard | |
| 6,481,420 | B1 | 11/2002 | Panasuk | |
| 6,539,920 | B1 | 4/2003 | Spiers | |
| 6,543,421 | B2 * | 4/2003 | Lorraine et al. | 123/470 |
| 6,601,564 | B2 | 8/2003 | Davey | |
| 6,668,803 | B1 | 12/2003 | McClean | |
| 6,705,292 | B2 | 3/2004 | Bugos | |
| 6,830,037 | B1 | 12/2004 | Braun | |
| 6,874,477 | B1 | 4/2005 | Lorraine | |
| 6,874,478 | B2 | 4/2005 | Minoura | |
| 7,159,570 | B2 | 1/2007 | Zdroik | |
| 7,360,524 | B2 | 4/2008 | Zdroik | |
| 2005/0116056 | A1 * | 6/2005 | Hans et al. | 239/5 |
| 2005/0161025 | A1 * | 7/2005 | Braun et al. | 123/470 |
| 2007/0266996 | A1 | 11/2007 | Zdroik | |
| 2007/0295309 | A1 | 12/2007 | Zdroik | |

* cited by examiner

*Primary Examiner*—Mahmoud Gimie
(74) *Attorney, Agent, or Firm*—Dykema Gossett PLLC

(57) ABSTRACT

A fuel delivery system comprising a fuel rail having an outlet and a receptor cup associated therewith. The system further including a fuel injector having an inlet, an outlet and a body therebetween. The inlet is configured for insertion into the cup of the fuel rail and for fluid communication with the outlet thereof. The system still further including a retention clip configured for engagement with the fuel injector and the cup in order to couple the fuel injector with the fuel rail. In the inventive system, the fuel injector further includes a load distribution feature. This feature is configured to engage a portion of the retention clip and to assist with the distribution about the clip of a load applied to the injector.

29 Claims, 7 Drawing Sheets

ATTACHMENT FOR FUEL INJECTORS IN DIRECT INJECTION FUEL SYSTEMS

FIELD OF THE INVENTION

The field of the present invention is fuel delivery systems. More particularly, the present invention relates to an arrangement for attaching one or more fuel injectors to a fuel rail in gasoline direct injection fuel delivery systems.

BACKGROUND OF THE INVENTION

Fuel delivery systems for direct injection applications, such as, for example, fuel-injected engines used in various types of on-road and off-road vehicles, typically include one or more fuel rails having a plurality of fuel injectors associated therewith. In such applications, the fuel rails may include a plurality of apertures or outlets in which injector sockets or cups are affixed. The fuel injectors are then inserted into the injector cups so as to allow for the fuel flowing in the fuel rail to be communicated to the fuel injectors. The fuel communicated from the fuel rail to the fuel injectors is then communicated to the combustion chamber of the engine associated with the fuel delivery system.

A challenge to these systems resides in the retention of the fuel injectors in the cups of the fuel rail in view of the relatively high system pressure (i.e., on the order of 10-30 MPa (1450-4350 psi)) and the pressure created as a result of combustion events occurring in the combustion chamber of the engine. One approach to meet this challenge has been to employ oversized standard external injector clips. In such an approach, the injector is inserted into the fuel rail and then an injector clip is coupled to both the injector and the cup to secure and retain the injector to and within the cup, while at the same time withstanding the load applied to the injector as a result of both the pressure of the system and the pressure created by the occurrence of a combustion event. Another approach has been the utilization of redundant clips to ensure the retention of the injector within the cup.

These approaches, however, are not without their disadvantages. For example, the respective size and positional tolerances of the cylinder head, fuel rail and injector causes the injector to not be exactly parallel with the injector cup. As a result, when the cup, injector and clip are assembled, there is a certain degree of misalignment between the injector and the cup. As a result, the load applied to the injector, clip, and/or rail primarily by the high pressure attendant in the system is overloaded to one side of the injector, thereby resulting in the application of a bending moment on the injector and/or clip, which can adversely impact the retention and orientation of the fuel injector within the cup of the fuel rail.

Therefore, there is a need for a fuel delivery system that will minimize and/or eliminate one or more of the above-identified deficiencies.

SUMMARY OF THE INVENTION

The present invention is directed to a fuel delivery system and the constituent components thereof. The inventive fuel delivery system comprises a fuel rail that defines a first longitudinal axis and that has an outlet and a receptor cup associated therewith. The inventive system further includes a fuel injector having an inlet, an outlet and a body therebetween. The inlet of the injector is configured for insertion into the cup of the fuel rail and for fluid communication with the outlet thereof. The inventive system still further includes a retention clip configured for engagement with the body of the fuel injector and the receptor cup in order to couple the fuel injector with the fuel rail. In the inventive system, the fuel injector body further includes a load distribution feature associated therewith. The load distribution feature is configured to engage a portion of the retention clip and to assist with the distribution about the clip of a load applied to the fuel injector as a result of a the pressure attendant in the system. Other apparatus are also presented that relate to the inventive fuel delivery system and its components.

Further features and advantages of the present invention will become more apparent to those skilled in the art after a review of the invention as it is shown in the accompanying drawings and detailed description.

DETAILED DESCRIPTION OF PREFERRED EMBODIMENTS

Figure 1:
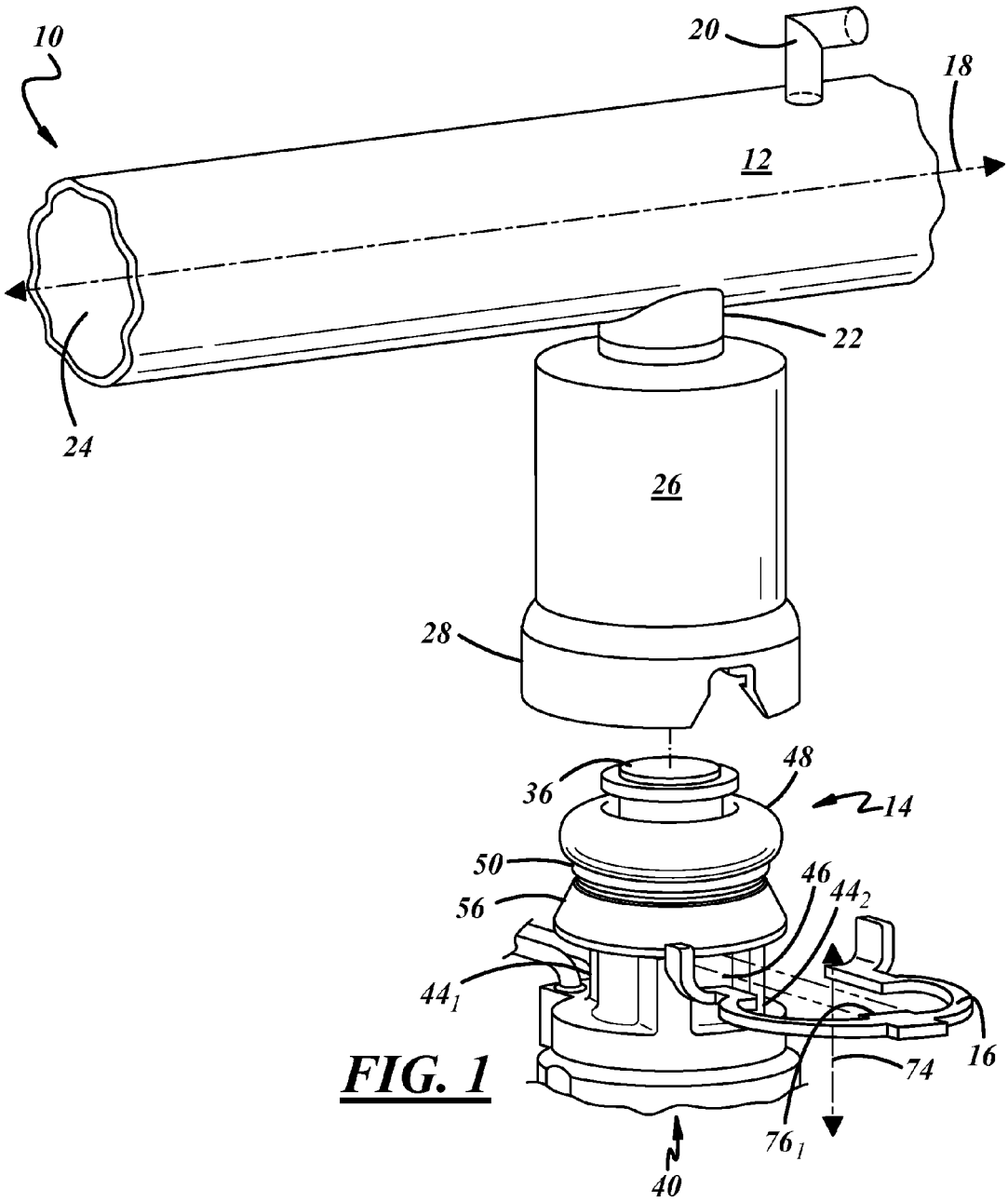
FIG. 1 is a perspective view of a portion of a fuel delivery system in accordance with the present invention in a disassembled state.

Referring now to the drawings wherein like reference numerals are used to identify identical components in the various views, FIGS. 1-3B illustrate one exemplary embodiment of a fuel delivery system 10 in various states of assembly. In an exemplary embodiment, fuel delivery system 10 includes a fuel rail 12, a fuel injector 14 and a retention clip 16.

With continued reference to FIGS. 1-3A, fuel rail 12 is a hollow-bodied fluid conduit that defines a longitudinal axis 18 extending from one end thereof to the other. Fuel rail 12 includes an inlet 20, at least one outlet 22, a fluid passageway 24 between said inlet 20 and outlet 22 and at least one receptor cup 26 associated with said outlet 22. Inlet 20 is configured to be coupled to a fuel source, such as, for example, the fuel tank of an automobile, to allow for the communication of fuel from the fuel source to fluid passageway 24 of fuel rail 12. Outlet 22 of fuel rail 12 is configured to allow communication of fuel from passageway 24 to the inlet of a respective injector 14 that is associated with outlet 22. Accordingly, fuel rail 12 facilitates the communication of fuel from a fuel source to the fuel injectors associated with fuel rail 12.

Fuel rail 12, as well as cup 26, may be formed of any number of materials. For instance, in one embodiment, fuel rail 12 is formed of a metal such as, for example, stainless steel. However, in an alternate embodiment, fuel rail 12 is formed of a thermoplastic material. In still other alternate embodiments, fuel rail 12 is formed of aluminum or an aluminum alloy, or a combination of materials, such as, for example, a thermoplastic coated aluminum tube/conduit. Accordingly, one of ordinary skill in the art will recognize that fuel rail 12 may be formed of any number of materials known in the art, and therefore, the fuel rail of the present invention is not limited to the exemplary constructions discussed above.

Figure 3A:
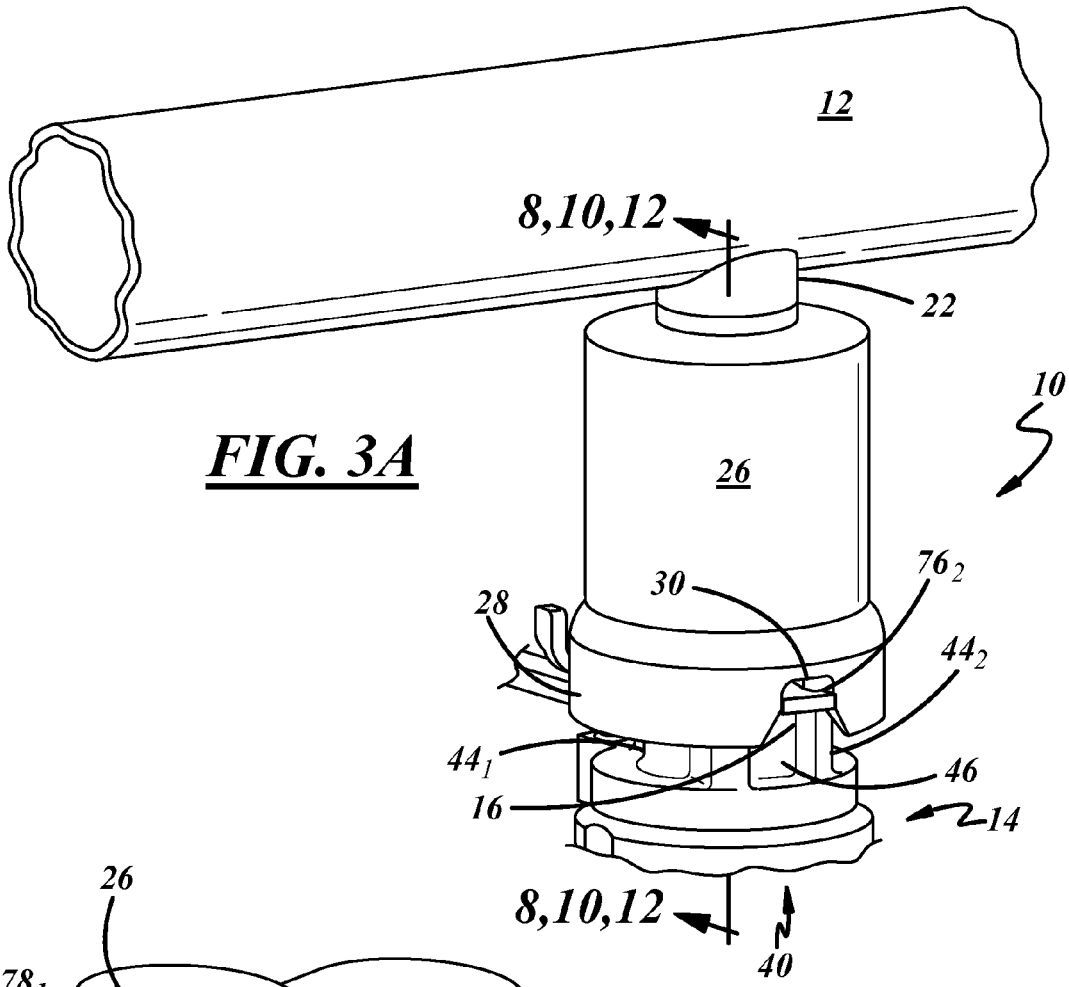
FIGS. 3A-3B are perspective views of portions of the inventive fuel delivery system in an assembled state.
Figure 3B:
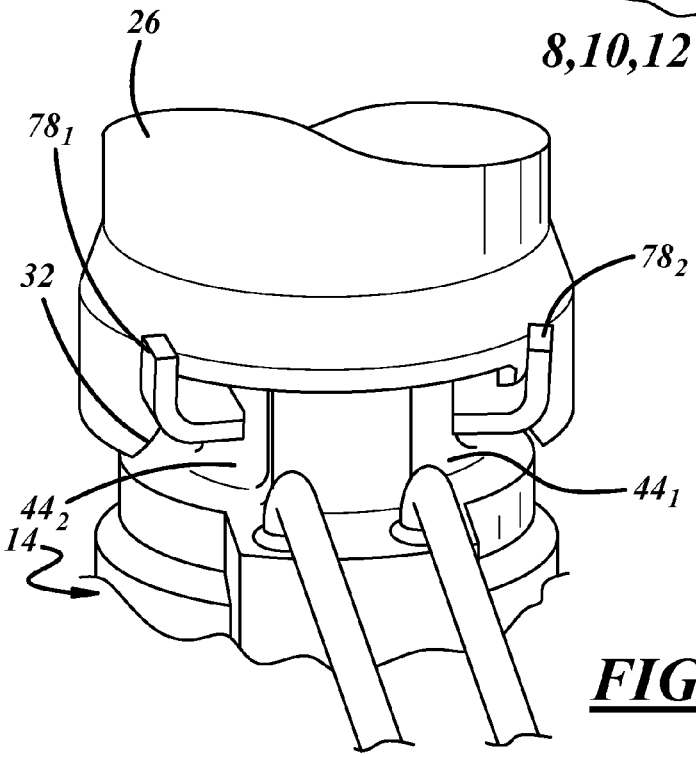
Figure 4:
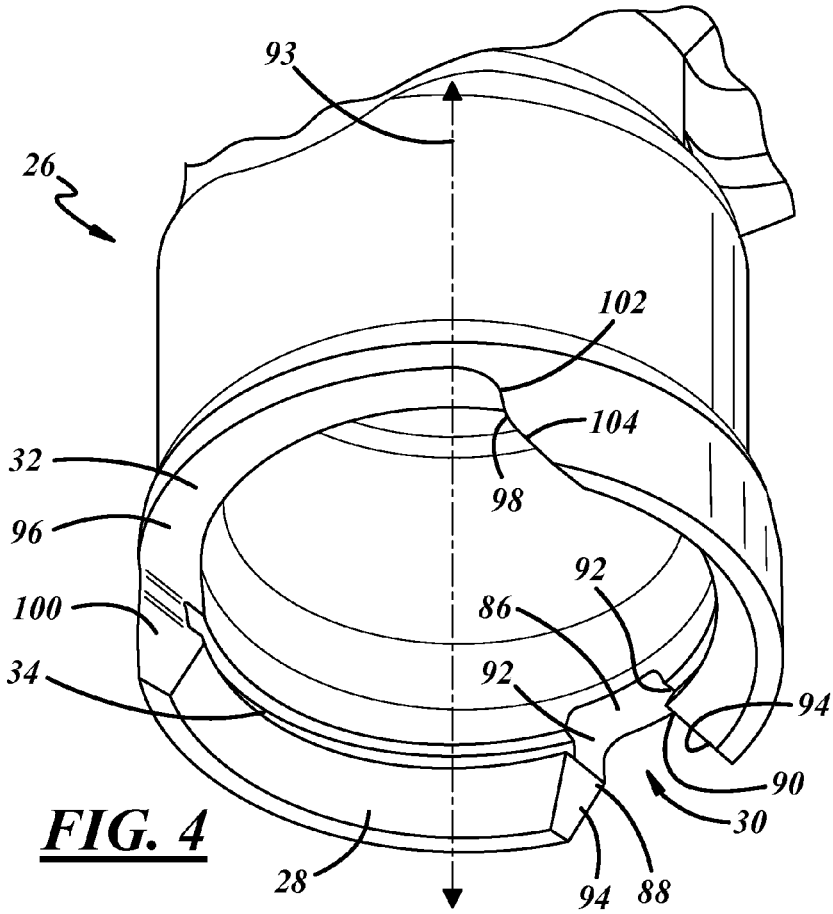
FIG. 4 is a perspective view of a receptor cup of the inventive fuel delivery system illustrated in FIGS. 1-3B.

With reference to FIGS. 1-4, receptor cup 26 is generally configured to receive a portion of injector 14, including the inlet thereof, and to allow for the communication of fuel from outlet 22 to fuel injector 14. Accordingly, cup 26 is operative to couple injector 14 with fuel rail 12, as well as to allow fuel to be communicated therebetween. FIG. 4 depicts an exemplary embodiment of cup 26. For reasons that will be described in greater detail below, cup 26 includes a rim portion 28 located at a distal end thereof. In an exemplary embodiment, rim portion 28 includes first and second slots 30, 32 therein that are disposed on diametrically opposite sides of cup 26, and that are configured, as will be described in greater detail below, for engagement with respective portions of retention clip 16. However, in other embodiments, rim portion 28 may have a single slot or more than two slots. Accordingly, the illustrated embodiment is provided for exemplary purposes only and is not meant to be limiting in nature.

With continued reference to FIG. 4, in an exemplary embodiment, rim portion 28 further includes an annular interior groove 34 in the inner surface of rim portion 28 that extends substantially continuously about the inner circumference of rim portion 28. As with slots 30, 32, groove 34 is configured to receive and engage a portion of retention clip 16. It should be noted that the present invention contemplates alternate embodiments wherein groove 34 is a continuous groove or a series of grooves that are not continuous with each other. For example, in one exemplary embodiment illustrated in FIG. 4, groove 34 is broken-up into segments by slots 30, 32. However, in an alternate embodiment, groove 34 may be a continuous groove spanning the entire circumference of rim 28.

In an exemplary embodiment, cup 26 is integrally formed with fuel rail 12 (i.e., fuel rail 12 is formed to have one or more cups 26). For instance, cup 26 may be stamped into fuel rail 12. In an alternate embodiment, cup 26 is a separate component that is assembled with and affixed to fuel rail 12 using, for example, brazing, welding or other like processes known in the art. In such an embodiment, a portion of cup 26 is inserted into outlet 22 and then affixed using one or more known processes. In either instance, cup 26 is aligned with outlet 22 to allow for the fuel in passageway 24 to be communicated to fuel injector 14, and the inlet thereof, in particular. In an exemplary embodiment fuel rail 12 includes a plurality of outlets 22 and a corresponding number of cups 26 wherein each cup 26 is associated with a respective outlet 22.

Figure 2:
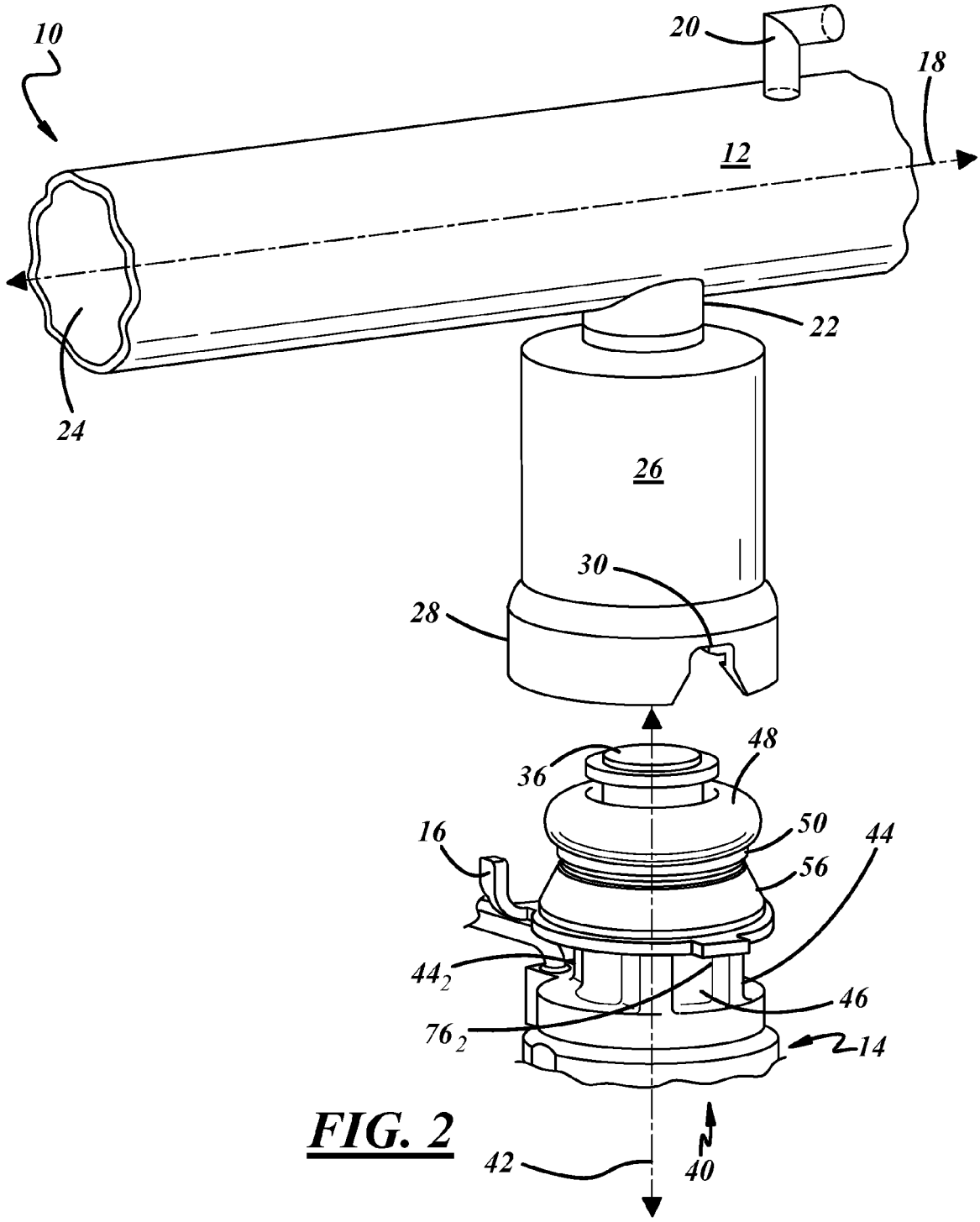
FIG. 2 is a perspective view of a portion of the inventive fuel delivery system in a partially assembled state.

With reference to FIGS. 1 and 2, fuel injector 14 will now be described. Fuel injector 14 includes an inlet 36, an outlet 38 (not shown) and a body 40 disposed therebetween. Inlet 36 is configured to be inserted into cup 26 of fuel rail 12 and for fluid communication with fuel rail outlet 22. Injector outlet 38 is configured for communication with a combustion chamber of the engine associated with the fuel delivery system and is subject to combustion pressure created from a combustion event occurring in the combustion chamber. Fuel injector 14 further defines a longitudinal axis 42 extending through inlet 36 and outlet 38 that is perpendicular to axis 18 of fuel rail 12 when fuel injector 14 is coupled with cup 26. When fuel delivery system 10 is coupled with the engine, the aforementioned combustion pressure applied to fuel injector is directed substantially coincident to axis 42.

In an exemplary embodiment, body 40 has a metal core and a plastic over-molded jacket. For reasons that will be described in greater detail below, body 40 includes one or more grooves 44 therein configured for receiving and mating with respective portions of an exemplary embodiment of retention clip 16. In the embodiment illustrated in FIGS. 1 and 2, body 40 includes a pair of grooves $\mathbf{44}_1$, $\mathbf{44}_2$ therein that are at diametrically opposite sides of body 40. In the illustrated embodiment, body 40 further includes a notch 46 therein that is disposed between grooves $\mathbf{44}_1$, $\mathbf{44}_2$ and that is configured to receive and mate with a separate portion of clip 16.

Figure 5:
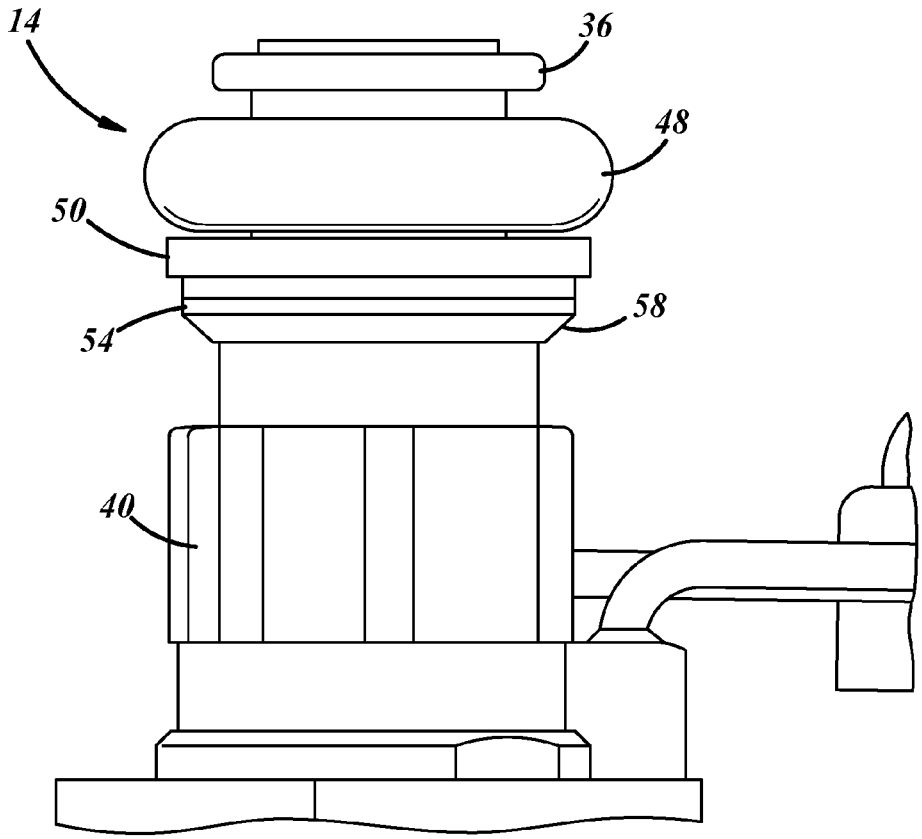
FIG. 5 is a side elevation view of a portion of a fuel injector of the inventive fuel delivery system illustrated in FIGS. 1-3B.
Figure 6:
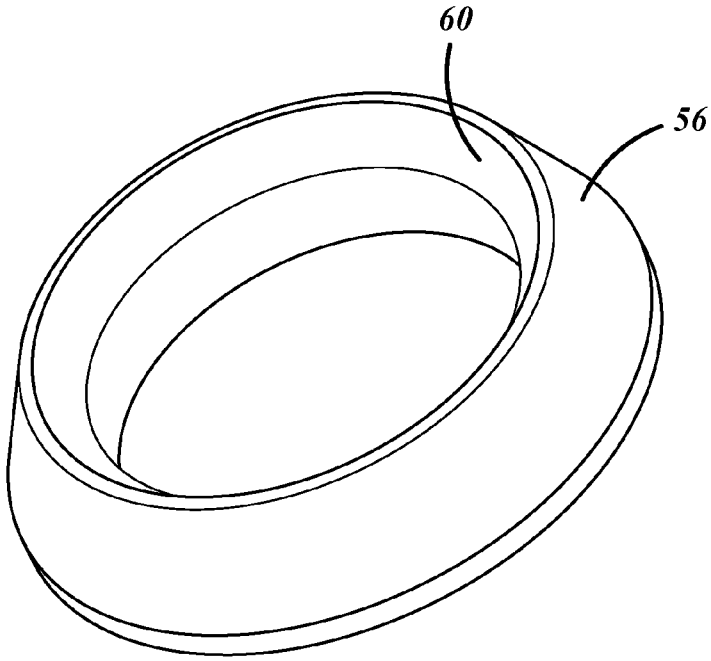
FIG. 6 is a perspective view of a washer of the inventive fuel delivery system illustrated in FIGS. 1-3B.

With continued reference to FIGS. 1 and 2, and with further reference to FIGS. 5 and 6, fuel injector 14 also includes an O-ring 48 and an O-ring backing washer 50. O-ring 48 is sealably engaged with inlet 36 and is configured to be sealably engaged with an interior portion of cup 26 proximate outlet 22 (best shown in FIG. 8). Accordingly, O-ring 48 and backing washer 50 cooperate to form a seal between injector 14 and fuel rail 12 so as to prevent, or at least substantially reduce, fuel and fuel vapors communicated between fuel rail outlet 22 and fuel injector inlet 36 from leaking. Fuel injector 14 further includes a load distribution feature 52 associated therewith. Load distribution feature 52 is configured to engage portions of retention clip 16 and the interior of cup 26; and to distribute the load resulting from the combustion and fuel pressure applied to injector 14, generally, and outlet 38 thereof, in particular, about the entirety of clip 16. Load distribution feature 52 is similarly configured to distribute the load resulting from the pressure of the fuel system as a whole that is applied to rail 12, cup 26 and injector 14 about the entirety of clip 16. In an exemplary embodiment, the load(s) is distributed substantially evenly throughout clip 16. In the illustrated embodiment, load distribution feature 52 comprises a load shoulder 54 and a washer 56.

With continued reference to FIG. 5, in an exemplary embodiment, load shoulder 54 is integrally formed with injector body 40. For example, load shoulder 54 may be machined into body 40. However, in an alternate embodiment, load shoulder 54 can be assembled with and affixed to body 40 by, for example, press-fitting load shoulder 54 onto body 40 or by using a welding process (e.g., laser welding) or another suitable process known in the art. Additionally, in an exemplary embodiment, load shoulder 54 is formed of a metallic material such as, for example, steel or stainless steel. However, those of ordinary skill in the art will recognize and appreciate that load shoulder 54 may be formed of other suitable materials known in the art.

In the exemplary embodiment illustrated in FIG. 5, load shoulder 54 is located proximate injector inlet 36, O-ring 48 and O-ring backing washer 50. More particularly, each of the aforementioned components are aligned and coaxial with each other, with load shoulder 54 abutting and engaging backing washer 50. It should be noted, however, that the present invention is not limited to such an arrangement. Rather, load shoulder 54 may be included with or without either or both of O-ring 48 and/or backing washer 50. Accordingly, those of ordinary skill in the art will recognize and appreciate that other arrangements of load shoulder 54 remain within the spirit and scope of the present invention.

In an exemplary embodiment, and for reasons to be described below, load shoulder 54 has an engagement portion 58 configured to engage washer 56. In the illustrated embodiment, engagement portion 58 has a rounded or spherical shape. However, the present invention is not meant to be so limited. Rather, injectors with a load shoulder 54 that includes an engagement surface 58 having a shape other than rounded or spherical remain within the spirit and scope of the present invention.

Figure 7:
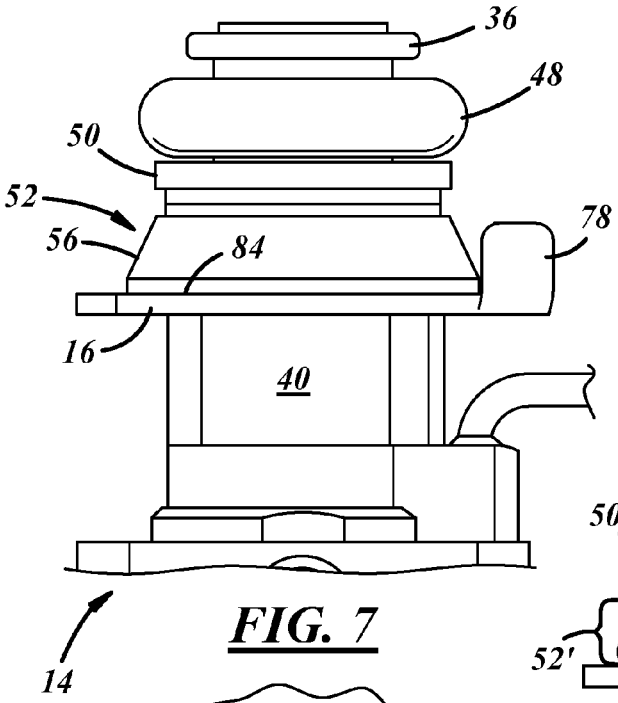
FIG. 7 is a side elevation view of a portion of the fuel injector illustrated in FIG. 5 with the washer of FIG. 6 coupled therewith.

With reference to FIGS. 6 and 7, washer 56 and fuel injector 14 comprising washer 56 are respectively illustrated. In an exemplary embodiment, washer 56 is formed of a metallic material, such as, for example, stainless steel. However, in alternate embodiments, washer 56 may be formed of any number of other materials, such as, for example, various types of plastic or ceramics. Additionally, washer 56 may be integrally formed with injector body 40 (i.e., washer 56 may be machined into body 40) or clip 16, or may be a separate component that is assembled with body 40. FIGS. 6 and 7 illustrate the latter embodiment.

In the embodiment illustrated in FIGS. 6 and 7, washer 56 has a seat 60 that is configured to receive and engage engagement portion 58 of load shoulder 54. Accordingly, in the embodiment wherein engagement portion 58 has a rounded or spherical shape, seat 60 has a beveled or rounded/spherical shape that is complementary with engagement portion 58. In an alternate embodiment, however, wherein engagement portion 58 has an alternate shape, seat 60 will likewise have a complementary alternate shape. Accordingly, the present invention is not limited to engagement portion 58 and seat 60 having a rounded or spherical shape. Washer 56 may have any number of shapes, however, in the embodiment illustrated in FIG. 6, washer 56 has a conical shape. In the embodiment illustrated in FIG. 6, washer 56 has a conical shape. In this embodiment, seat 60 is disposed at the vertex of conical washer 56 (i.e., on the inner surface thereof), and the base portion of washer 56 is configured for engagement with clip 16 so as to create a continuous line of contact about washer 56 and clip 16 (best shown in FIG. 7). Accordingly, when assembled, washer 56 is captured between clip 16 and load shoulder 54. Additionally, the outside "angled" surface of washer 56 is configured to abut and engage the inner surface of cup 26 when injector 14 is inserted therein. This arrangement prevents injector 14 from being pushed or inserted too far into cup 26.

In an exemplary embodiment, load distribution feature 52 is assembled with injector 14 as follows. First, washer 56 is slipped onto injector 14. Next, load shoulder 54 is similarly slipped onto and affixed to injector 14, and body 40 thereof, in particular. However, in an alternate embodiment, load shoulder 54 is coupled with injector 14 first, and then washer 56 is assembled with injector 14 prior to inserting injector 14 into cup 26. In such an embodiment, washer 56 is a two-piece washer wherein the two pieces are mated and engage with each other when they are assembled with injector 14. In still another alternate embodiment, the spilt washer 56 is assembled with injector 14 first, and then load shoulder 54 is coupled with injector 14. In yet still another alternate embodiment, washer 56 has a horseshoe shape to allow washer 56 to be radially slide onto body 40. In such an embodiment, washer 56 does not extend completely around body 40. Accordingly, one of ordinary skill in the art will appreciate and recognize that load distribution feature 52 may be assembled in a variety of ways, and thus, the present invention is not meant to be limited solely to those methods of assembly set forth above.

Accordingly, when fuel delivery system 10 is assembled as described above and as illustrated in FIGS. 1-3B and 8, and as the various forces described above are applied to injector 14 and/or clip 16, thereby inducing movement or pivoting of injector 14, engagement portion 58 of load shoulder 54 can rotate or ride within conical washer 56 while maintaining even loading all along the line of contact between washer 56 and clip 16, thereby preventing one side of injector 14 and clip 16 from being overloaded and also ensuring the retention of injector 14 within cup 26. Accordingly, this arrangement allows for a certain amount of misalignment of injector 14, while also maintaining the distribution of the load about clip 16.

Figure 9:
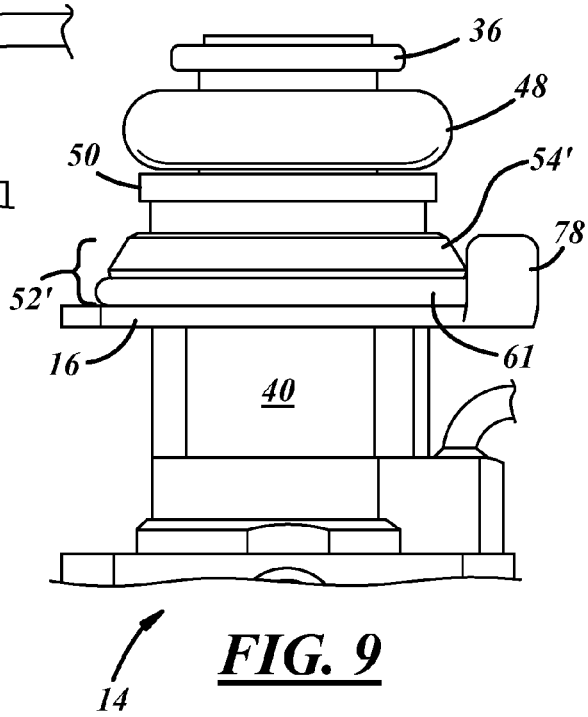
FIG. 9 is side elevation view of a portion of an alternate embodiment of the fuel delivery system illustrated in FIGS. 1-8.
Figure 10:
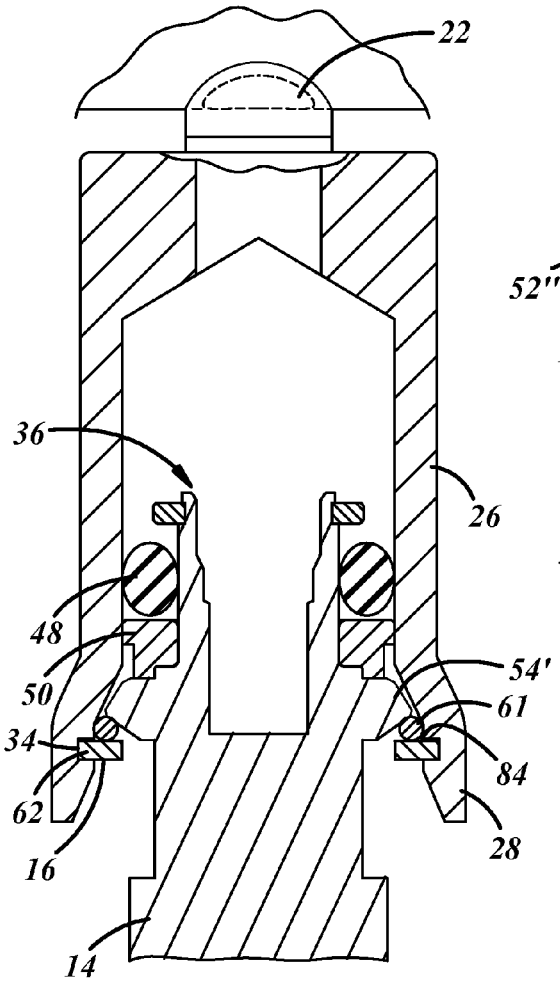
FIG. 10 is a cross-section view of the combination of the retention cup and fuel injector of the fuel delivery system illustrated in FIG. 9 taken along the line 10-10 in FIG. 3A.

FIGS. 9 and 10 illustrate an alternate exemplary embodiment of load distribution feature 52. In this embodiment, load distribution feature 52' includes a load shoulder 54', which is machined into or otherwise affixed to the core of injector 14 (i.e., injector body 40), and a ring 61 that is configured to be coupled with injector body 40. As will be described in greater detail below, when coupled with injector 14, ring 61 serves as an interface between load shoulder 54' and clip 16, and also engages a portion of load shoulder 54' and upper surface 84 of clip 16.

In an exemplary embodiment, ring 61 has a split-ring construction to facilitate coupling with injector 14. Preferably, split-ring 61 is elastically-deformable. As such, ring 61 is configured to be opened permit the placement of ring 61 onto injector body 40, and also sufficiently elastic to cause ring 61 to contract or spring back to its original shape, or close thereto, once ring 61 is in the proper position on body 40. In an exemplary embodiment, ring 61 may be formed of, for example, spring grade steel. However, the present invention is not so limited. Rather, those of ordinary skill in the art will recognize that any number of materials having the requisite elasticity and strength may be used. While an elastic split-ring arrangement is discussed in detail above, ring 61 is not limited to such a construction. For instance, in an alternate embodiment, rather than being elastic, ring 61 may have an alternate construction that allows for ring 61 to be opened and closed using various mechanical latching/hinging arrangements known in the art. Accordingly, ring 61 of the present invention is not limited solely to the elastic split-ring construction. Additionally, while ring 61 illustrated in FIG. 10 has a circular cross-sectional shape, the present invention is not so limited. Rather, those of ordinary skill in the art will recognize that ring 61 may take on any number of cross-sectional shapes other than circular, and thus, these other cross-sectional shapes, such as, for example, a triangular shape, remain within the spirit and scope of the present invention.

When assembled with injector 14 and clip 16, ring 61 is disposed between load shoulder 54' and clip 16. More particularly, ring 61 circumscribes injector body 40 and is configured to interface with and engage a portion of load shoulder 54' and upper surface 84 of clip 16. As illustrated in FIG. 9, in one exemplary embodiment, load shoulder 54' has an upper conically-shaped portion and a lower conically-shaped portion; however, the present invention is not limited solely to conically-shaped portions. In the illustrated embodiment, when assembled with cup 26, the "angled" surface of the upper conically-shaped portion of load shoulder 54' is configured to abut and engage the inner surface of cup 26 when injector 14 is inserted therein. This arrangement prevents injector 14 from being pushed or otherwise inserted too far into cup 26. The lower conically-shaped portion of load shoulder 54' is configured to engage the surface of ring 61. In this embodiment, the two conically-shaped portions of load shoulder 54' allow injector 14 to pivot on both sides of load shoulder 54', as opposed to just on the top side of washer 56, which is what is permitted by the embodiment described above comprising load shoulder 54 and washer 56. Accordingly, as with the embodiment described above wherein the combination of load shoulder 54 and washer 56 allows for a certain degree of misalignment of the injector while also maintaining the distribution of the load about the clip, the interaction between load shoulder 54' and ring 61 likewise allows substantially even load distribution about clip 16, as well as for angular loading about clip 16 during misalignment of the injector. Accordingly, as the various forces described above are applied to injector 14, clip 16, and/or rail 12 and cause movement or pivoting of the injector, for example, the surface of the lower conically-shaped portion of load shoulder 54' in contact with ring 61 is allowed to ride along the surface of ring 61 (as engagement portion 58 of load shoulder 54 was allowed to rotate or ride within the seat 60 of washer 56 in the embodiment described above), all while at the same time maintaining even loading along the line of contact between ring 61 and clip 16. This prevents one side of injector 14 and the corresponding portion of clip 16 from being overloaded and also ensures retention of injector 14 within cup 26.

Figure 11:
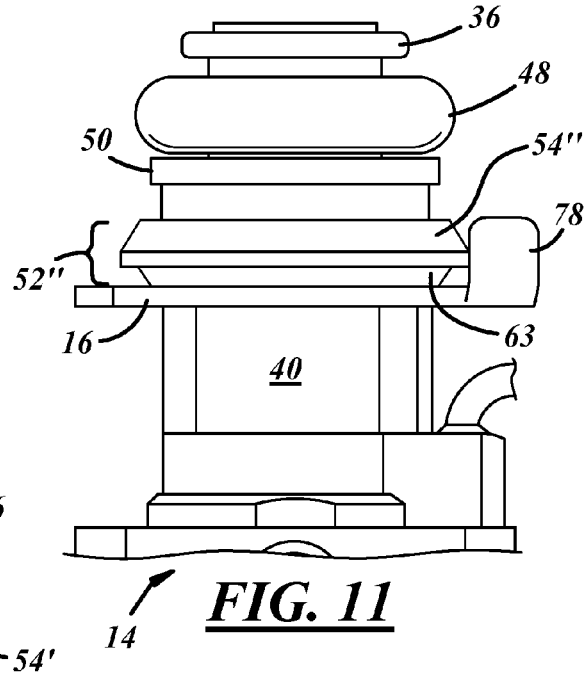
FIG. 11 is a side elevation view of a portion of yet another alternate embodiment of the fuel delivery systems illustrated in FIGS. 1-8 and 9-10, respectively.
Figure 12:
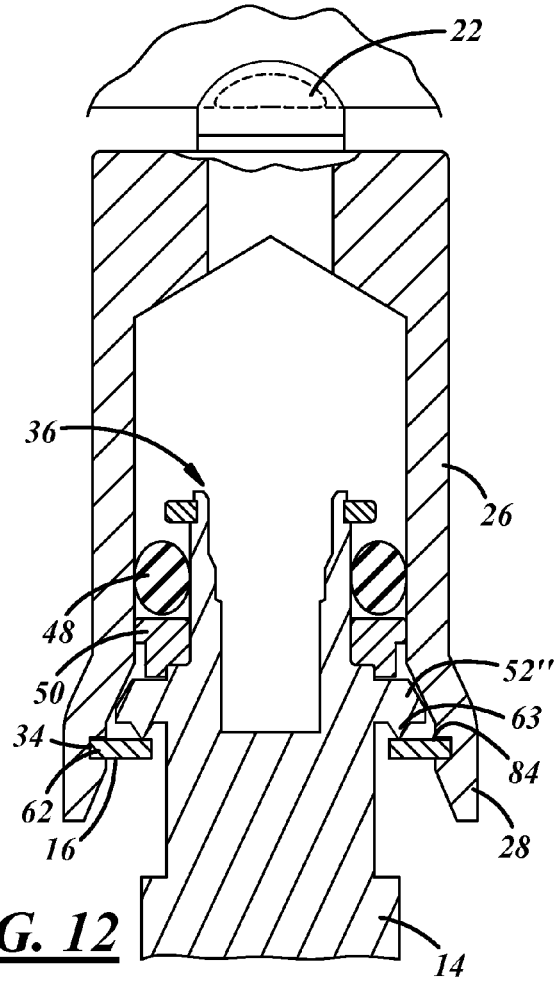
FIG. 12 is a cross-section view of the combination of the retention cup and fuel injector of the fuel delivery system illustrated in FIG. 11 taken along the line 12-12 in FIG. 3A.

FIGS. 11 and 12 illustrate yet another exemplary embodiment of load distribution feature 52. In this embodiment, load distribution feature 52" includes a load shoulder 54", which is machined into or otherwise affixed to the core of injector 14 (i.e., injector body 40). In the illustrated embodiment, load shoulder 54" has a conical shape (although the present invention is not limited solely to a conical shape) and includes a protrusion 63 extending from the base thereof. Protrusion 63 is configured and operative to engage upper surface 84 of clip 16 when clip 16 is assembled with injector 14. Protrusion 63 may taken on a variety of shapes. For example, as illustrated in FIGS. 11 and 12, protrusion may have a triangular shape. However, in alternate embodiments, protrusion 63 may have a different shape, such as for example, a spherical shape. Therefore, one of ordinary skill in the art will appreciate that protrusion 63 may have any number of shapes. As with the embodiments described above, when injector 14 and clip 16 are assembled with cup 26, the "angled" portion/surface of conically-shaped load shoulder 54" is configured to abut and engage the inner surface of cup 26 when injector 14 is inserted therein. This arrangement prevents injector 14 from being pushed or otherwise inserted too far into cup 26.

Accordingly, as with the embodiments described above, this embodiment allows a certain degree of misalignment of the injector while also maintaining the distribution of the load about the clip. The interaction between protrusion 63 and clip 16 also allows substantially even load distribution about clip 16, as well as for angular loading about clip 16 during misalignment of the injector. Accordingly, as the various forces described above are applied to injector 14 and cause movement or pivoting thereof, protrusion 63 of load shoulder 54" in contact with upper surface 84 of clip 16 is allowed to ride along upper surface 84 or to move to a new position, while also maintaining even loading along the line of contact between protrusion 63 and clip 16 and in the new position. This prevents one side of injector 14 and the corresponding portion of clip 16 from being overloaded and also ensures retention of injector 14 within cup 26.

Figure 13:
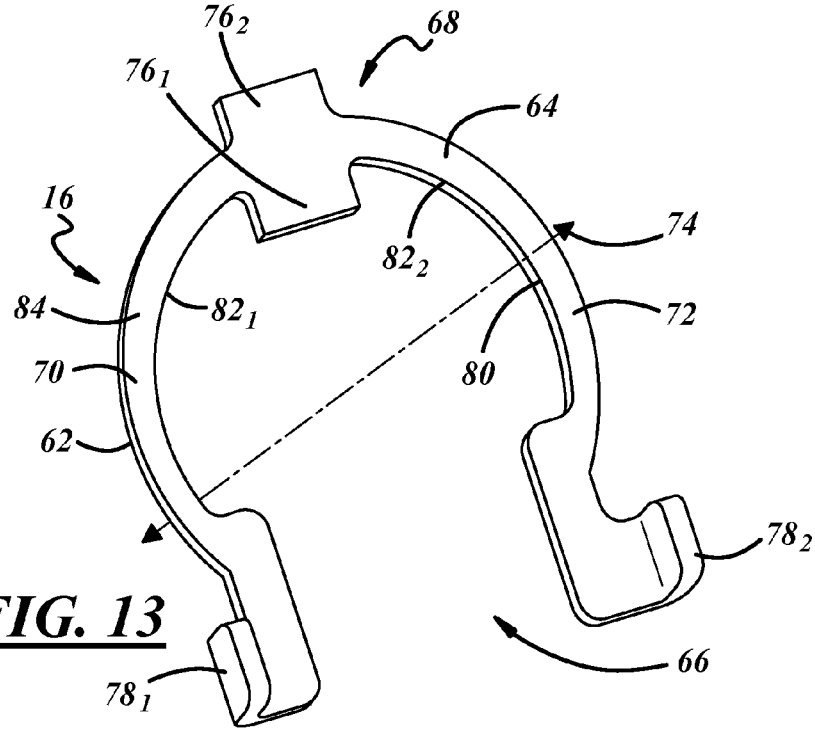
FIG. 13 is a perspective view of an exemplary embodiment of a fuel injector retention clip in accordance with the present invention.

With reference to FIG. 13, an exemplary embodiment of retention clip 16 is illustrated. It should be noted that while only the illustrated embodiment of clip 16 is described here in detail, those of ordinary skill in the art will recognize and appreciate that the present invention can be adapted to utilize other types of clips known in the art. A detailed description of the illustrated clip and the arrangement of the clip, injector and fuel rail cup can be found in U.S. patent application Ser. No. 11/361,550 entitled Fuel Injector Retention Clip (U.S. Patent Publication No. 2006/0137659 A1) filed on Feb. 24, 2006, which is owned by the common assignee of the present invention and also has the same inventors as the present invention. This application is hereby incorporated herein by reference in its entirety.

Figure 8:
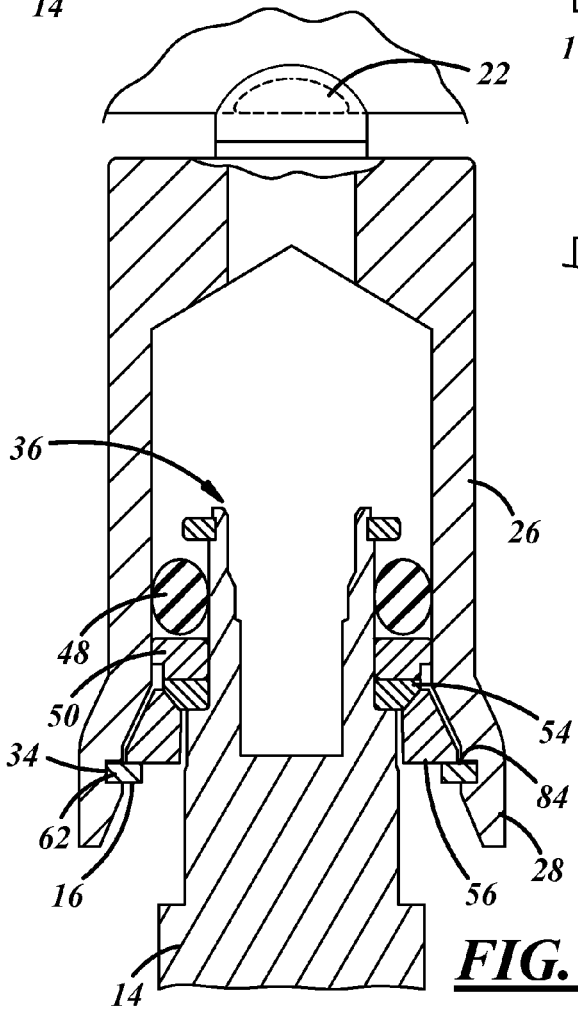
FIG. 8 is a cross-section view of a portion of the combination of the retention cup and fuel injector of the inventive fuel delivery system taken along the line 8-8 of FIG. 3A.

As generally described above, clip 16 is operative to retain injector 14 within cup 26. In the illustrated exemplary embodiment, clip 16 is configured to be coupled with injector 14 prior to injector 14 being inserted into cup 26, however, in alternate embodiments clip 16 can be coupled to injector 14 after injector 14 is inserted into cup 26. As illustrated in FIGS. 3A, 3B and 8, in one exemplary embodiment, clip 16 is configured to be inserted into cup 26 along with injector 14. In one arrangement of this embodiment, an outer peripheral surface 62 of clip 16 is configured to be inserted in groove 34 of cup 26. As will be described in greater detail below, inserting the combination of injector 14 and clip 16 into cup 26 serves to prevent injector 14 from being rotated and to better retain injector 14 within cup 26.

In this particular embodiment, clip 16 has a base 64, which in turn includes an open end 66, a closed end 68 opposite open end 66, a first side 70 and a second side 72 opposite first side 70. Clip 16 further defines a vertical axis 74 extending through the center thereof. In this exemplary embodiment, clip 16 further includes a pair of tabs $\mathbf{76}_1$, $\mathbf{76}_2$ protruding from either side of closed end 68 of base 64 in a radial direction relative to axis 74. As will be described in greater detail below, tab $\mathbf{76}_1$ is configured for insertion into and engagement with notch 46 in injector 14 when injector 14 and clip 16 are mated together. Tab $\mathbf{76}_2$, on the other hand, is sized and configured for insertion into first slot 30 of cup 26 when the combination of injector 14 and clip 16 are inserted into cup 26. Together, tabs $\mathbf{76}_1$, $\mathbf{76}_2$ provide orientation of injector 14 for off centerline injector spray applications, and prevent injector 14 from being rotated within cup 26.

With continued reference to FIG. 13, clip 16 still further includes a pair of ears $\mathbf{78}_1$, $\mathbf{78}_2$ each disposed at either side of open end 66 of base 64 that extend upwards in an axial direction relative to axis 74. Ears $\mathbf{78}_1$, $\mathbf{78}_2$ serve to define a width of the opening at open end 66. As will be described in greater detail below, ears $\mathbf{78}_1$, $\mathbf{78}_2$ are spaced a predetermined distance apart so as to be slightly larger in width than the width of second slot 32 of cup 26. In this arrangement, when clip 16 is assembled with injector 14 and the combination is inserted into cup 26, ears $\mathbf{78}_1$, $\mathbf{78}_2$ are located proximate to the sides of slot 32, and are engaged with the outer surface of cup 26.

With reference to FIG. 13, in addition to outer peripheral surface 62 described above, clip 16 further includes an interior surface 80 opposite peripheral surface 62. Interior surface 80 includes a pair of arcuate recessed portions $\mathbf{82}_1$, $\mathbf{82}_2$, one on either side 70, 72 of base 64. Recessed portions $\mathbf{82}_1$, $\mathbf{82}_2$ are configured in size, shape and location on clip 16 to engage corresponding grooves $\mathbf{44}_1$, $\mathbf{44}_2$ in body 40 of injector 14. Grooves $\mathbf{44}_1$, $\mathbf{44}_2$ are sized to have a slightly larger arcuate length than that of recessed portions $\mathbf{82}_1$, $\mathbf{82}_2$.

With reference to FIGS. 1-3B, the coupling of clip 16 with injector 14 and the insertion of the injector/clip combination into cup 26 will be described. As shown in FIGS. 1 and 2, to assemble clip 16 and injector 14 together, arcuate recessed portions $\mathbf{82}_1$, $\mathbf{82}_2$ are radially aligned relative to axis 74 with grooves $\mathbf{44}_1$, $\mathbf{44}_2$ of injector 14. Open end 66 of clip 16 is then pushed and slid onto injector 14 in a radial direction. As clip 16 is pushed against injector body 40, injector 14 engages and slides against interior surface 80, forcing the opening at open end 66 to deflect and widen to accommodate the size of injector 14. Once recessed portions $\mathbf{82}_1$, $\mathbf{82}_2$ and grooves $\mathbf{44}_1$, $\mathbf{44}_2$, meet and are aligned, recessed portions $\mathbf{82}_1$, $\mathbf{82}_2$ are seated in grooves $\mathbf{44}_1$, $\mathbf{44}_2$, respectively. Additionally, as grooves $\mathbf{44}_1$, $\mathbf{44}_2$ and arcuate portions $\mathbf{82}_1$, $\mathbf{82}_2$ are engaged, notch 46 and tab $\mathbf{76}_1$ are likewise engaged such that tab $\mathbf{76}_1$ is seated within notch 46. Finally, as described above, an upper surface 84 of base 64 is configured to abut and engage a portion of load distribution feature 52. Accordingly, clip 16 is either aligned such that when it is slid onto injector 14 it is done so proximate load distribution feature 52, or is slid onto injector 14 and then axially moved into place. In the embodiment described above wherein load distribution feature 52 comprises, in part, conical washer 56, the base portion of washer 56 abuts and engages surface 84 of clip 16. In the alternate embodiment wherein load distribution feature 52 comprises, in part, load shoulder 54' and ring 61, ring 61 abuts and engages surface 84 of clip 16. In either embodiment, once clip 16 and injector 14 are fully assembled, the opening of clip 16 reflects back to at least close to its original width. This arrangement serves, at least in part, to prevent clip 16 from being rotated about injector 14, and to create a continuous line of contact between injector 14 (i.e., load distribution feature 52) and clip 16 around the entire circumference of clip 16. In order to remove injector 14 from clip 16, the opening of clip 16 is pulled open and the injector can be extracted.

With reference to FIGS. 2-3B, once injector 14 and clip 16 are assembled together, the injector/clip combination is inserted into cup 26. To do so, tab $\mathbf{76}_2$ on clip 16 is aligned with slot 30 in cup 26, and ears $\mathbf{78}_1$, $\mathbf{78}_2$ are aligned with slot 32 in cup 26. As the combination is pressed into cup 26, tab $\mathbf{76}_2$ is inserted into slot 30, and ears $\mathbf{78}_1$, $\mathbf{78}_2$ are inserted into slot 32. With reference to FIG. 4, which depicts cup 26 in detail, slot 30, which has a smaller width than that of slot 32, has a bottom 86, a first side 88 and a second side 90. Sides 88, 90 each include a vertical portion 92 extending from bottom 86 that are substantially parallel to vertical axis 93 of cup 26 (which is perpendicular to axis 18 and coaxial with axes 42 and 74 when injector 14, clip 16 and cup 26 are assembled together). Sides 88, 90 each further include an angled portion 94 that extend away from the interior of slot 30 at predetermined angles from vertical portion 92 of each side to the distal end of rim 28 of cup 26. Accordingly, when tab $\mathbf{76}_2$ is inserted into slot 30, the outer peripheral surface of tab $\mathbf{76}_2$ is in contact with sides 88, 90 so as to hold injector 14 and clip 16 in place and to prevent the combination from rotating within cup 26.

As set forth above, as tab $\mathbf{76}_2$ is inserted into slot 30, ears $\mathbf{78}_1$, $\mathbf{78}_2$ are simultaneously inserted into slot 32. With continued reference to FIG. 4, slot 32 includes a base or bottom 96 and a pair of sides 98, 100. Sides 98, 100 each include a vertical portion 102 extending from slot bottom 96 that are substantially parallel to axis 93 of cup 26. Sides 98, 100 each also include an angled portion 104 that extend away from the interior of slot 36 at predetermined angles from vertical portion 102 of each side to the distal end of rim 28. As the injector/clip combination is pressed into cup 26, ears $\mathbf{78}_1$, $\mathbf{78}_2$ are pressed toward each other to fit within slot 32. In an embodiment wherein cup 26 further includes groove 34, the outer peripheral surface 62 of clip 16 is inserted into and placed in engagement with groove 34 once the injector/clip combination is inserted into cup 26. Then, once clip 16 inserted into slot 32 and aligned with groove 34 (if appropriate), the pressure applied to ears $\mathbf{78}_1$, $\mathbf{78}_2$ is released, and the ears $\mathbf{78}_1$, $\mathbf{78}_2$ of clip 16 deflect back, engaging sides 98, 100 of slot 32. Similarly, the outer peripheral surface 62 of clip 16 engages the inner surface of groove 34. It should be noted that although the pressure applied to ears $\mathbf{78}_1$, $\mathbf{78}_2$ when inserting the injector/clip combination into cup 26 is released, because the width of slot 32 is less than the width between ears $\mathbf{78}_1$, $\mathbf{78}_2$, ears $\mathbf{78}_1$, $\mathbf{78}_2$ apply a continuous torsional force against sides 98, 100 of slot 32.

Once the injector/clip combination is in place within slots 30, 32, a portion of each ear $\mathbf{78}_1$, $\mathbf{78}_2$ is exposed such that the injector/clip combination can be easily removed from cup 26 by pressing ears $\mathbf{78}_1$, $\mathbf{78}_2$ towards each other and pulling the combination out of cup 26. Accordingly, the arrangement and interaction of injector 14, clip 16 and cup 26 serve to axially and radially retain injector 14 within cup 26 and to prevent the rotation of injector 14 once it is inserted therein, thereby limiting the axial and torsional movement of fuel injector 14. The nature of clip 16 being inserted into cup 26 prevents the inadvertent opening of clip 16, and therefore, the release of injector 14 therefrom. Accordingly, clip 16 being internal to cup 26 further assists with the retention and anti-rotation of injector 14.

While the invention has been particularly shown and described with reference to the preferred embodiments thereof, it is well understood by those skilled in the art that various changes and modifications can be made in the invention without departing from the spirit and scope of the invention.

The invention claimed is:

1. A fuel delivery system, comprising:

a fuel rail defining a first longitudinal axis and having an outlet and a receptor cup associated with said outlet, said receptor cup having an inner surface and an outer surface;

a fuel injector having an inlet, an outlet and a body therebetween, said inlet configured for insertion into said cup and for fluid communication with said fuel rail outlet; and a retention clip configured for engagement with said fuel injector body and said inner surface of said receptor cup in order to couple said fuel injector with said fuel rail; wherein said fuel injector body further includes a load distribution feature, said load distribution feature configured to engage a portion of said retention clip and to distribute about said clip a load applied to said fuel injector.

2. A fuel delivery system in accordance with claim 1 wherein said load distribution feature comprises the combination of a load shoulder and a washer, and wherein said washer engages said load shoulder and said retention clip.

3. A fuel delivery system in accordance with claim 2 wherein said load shoulder includes a rounded portion extending circumferentially about said body of said injector and said washer includes a complementary beveled seat extending circumferentially about said washer, said rounded portion and said beveled seat configured to be engaged with each other.

4. A fuel delivery system in accordance with claim 3 wherein said washer has a conical shape comprising a base that engages a portion of said retention clip and a vertex, the inner surface of which comprises said beveled seat.

5. A fuel delivery system in accordance with claim 4 wherein the outer angled surface of said conically-shaped washer is configured to engage said inner surface of said cup when said injector is inserted in said cup.

6. A fuel delivery system in accordance with claim 1 wherein said load distribution feature comprises a load shoulder and a ring, and further wherein said ring is configured to be assembled with said fuel injector body and to engage said load shoulder and said retention clip.

7. A fuel delivery system in accordance with claim 6 wherein said load shoulder includes an upper conically-shaped portion comprising said conically-shaped portion of said load distribution feature, configured to engage the inner surface of said cup when said injector is inserted into said cup and a conically-shaped lower portion configured to engage said ring.

8. A fuel delivery system in accordance with claim 6 wherein said ring comprises an elastically-deformable split-ring.

9. A fuel delivery system in accordance with claim 1 wherein said load distribution feature comprises a load shoulder, and further wherein said load shoulder includes a protrusion extending therefrom configured to engage said retention clip.

10. A fuel delivery system in accordance with claim 9 wherein said load shoulder has a conical shape comprising a base and an outer angled surface, and further wherein said outer angled surface is configured to engage the inner surface of said cup when said injector is inserted into said cup, and said protrusion extends from the base of said load shoulder.

11. A fuel injector, comprising:

an inlet configured to communicated fuel with an outlet of a fuel rail associated therewith;

an outlet configured to communicate fuel to an engine associated with said fuel injector; and a body disposed between said inlet and said outlet configured to mate with a retention clip, said body including a load distribution feature, said load distribution feature configured to engage a portion of said retention clip and to distribute about said clip a load applied to said fuel injector, wherein said load distribution feature comprises a load shoulder and a washer wherein said load shoulder is disposed between said inlet and said washer, and further wherein said washer engages said load shoulder and is configured for engagement with said retention clip.

12. A fuel injector in accordance with claim 11 wherein said load shoulder includes a rounded portion extending circumferentially about said body of said injector and said washer includes a complementary beveled seat extending circumferentially about said washer, said spherical portion and said beveled portion configured to be engaged with each other.

13. A fuel injector in accordance with claim 12 wherein said washer has a conical shape, the base of which is configured for engagement with said retention clip and the inner surface of the vertex of which comprises said beveled seat.

14. A fuel injector in accordance with claim 13 wherein said conically-shaped washer is configured to engage the inner surface of said cup when said injector is inserted in said cup.

15. A fuel injector in accordance with claim 11 where said washer is configured to be assembled with said fuel injector body.

16. A fuel injector in accordance with claim 12 wherein said body includes a pair of grooves therein configured to mate with corresponding portions of said retention clip when said retention clip is coupled with said fuel injector.

17. A fuel injector in accordance with claim 12 wherein said body further includes a notch therein configured to mate with a tab on said retention clip when said retention clip is coupled with said fuel injector.

18. A fuel injector, comprising:

an inlet configured to communicated fuel with an outlet of a fuel rail associated therewith;

an outlet configured to communicate fuel to an engine associated with said fuel injector; and a body disposed between said inlet and said outlet configured to mate with a retention clip, said body including a load distribution feature, said load distribution feature configured to engage a portion of said retention clip and to distribute about said clip a load applied to said fuel injector, wherein said load distribution feature comprises a load shoulder and a ring, and further wherein said ring is configured to be assembled with said body and to engage said load shoulder and said retention clip.

19. A fuel injector in accordance with claim 18 wherein said load shoulder includes an upper conically-shaped portion configured to engage the inner surface of said cup when said injector is inserted into said cup, and a lower conically-shaped portion configured to engage said ring.

20. A fuel injector in accordance with claim 18 wherein said ring comprises an elastically-deformable split-ring.

21. A fuel injector, comprising:

an inlet configured to communicated fuel with an outlet of a fuel rail associated therewith;

an outlet configured to communicate fuel to an engine associated with said fuel injector; and a body disposed between said inlet and said outlet configured to mate with a retention clip, said body including a load distribution feature, said load distribution feature configured to engage a portion of said retention clip and to distribute about said clip a load applied to said fuel injector, wherein said load distribution feature comprises a load shoulder, and further wherein said load shoulder includes a protrusion extending therefrom configured for engagement with said retention clip.

22. A fuel delivery system in accordance with claim 21 wherein said load shoulder has a conical shape comprising a base and an outer angled surface, said further wherein said outer angled surface is configured for engagement with the inner surface of said cup when said injector is inserted into said cup, and said protrusion extends from the base of said load shoulder.

23. An apparatus for use with a fuel injector having an inlet and a load shoulder, comprising:

a hollow bodied fluid conduit having an inlet, an outlet and a flow passageway therebetween, said inlet configured to receive fuel from a fuel source and said passageway configured to communicate fuel between said inlet and said outlet, said conduit further including a receptor cup associated with said outlet configured to receive an inlet of a fuel injector such that fuel in said passageway can be communicated to said fuel injector;

a retention clip configured to be assembled with said fuel injector to couple said fuel injector with said cup and to retain said fuel injector therein; and a conically-shaped washer associated with said fuel injector and disposed between said load shoulder and said retention clip, said washer configured to engage both said load shoulder and said retention clip when said washer and said clip are assembled with said fuel injector, said washer operative to distribute about said clip a pressure load applied to said fuel injector.

24. An apparatus in accordance with claim 23 wherein said washer includes a beveled seat extending circumferentially about said washer, said beveled seat configured to be engaged with a rounded portion of said load shoulder that extends circumferentially about the body of said injector.

25. An apparatus in accordance with claim 24 wherein the base of said conically-shaped washer engages a portion of said retention clip, and the inner surface of the vertex of said conically-shaped washer comprises said beveled seat.

26. An apparatus in accordance with claim 23 wherein the outer surface of said conically-shaped washer is configured to engage the inner surface of said cup when the combination of said injector and said clip is inserted in said cup.

27. An apparatus for use with a fuel injector having an inlet and a load shoulder, comprising:

a hollow bodied fluid conduit having an inlet, an outlet and a flow passageway therebetween, said inlet configured to receive fuel from a fuel source and said passageway configured to communicate fuel between said inlet and said outlet, said conduit further including a receptor cup associated with said outlet configured to receive an inlet of a fuel injector such that fuel in said passageway can be communicated to said fuel injector;

a retention clip configured to be assembled with said fuel injector to couple said fuel injector with said cup and to retain said fuel injector therein; and a ring associated with said fuel injector and disposed between said load shoulder and said retention clip, said ring configured to engage the surface of a conically-shaped portion of said load shoulder and said retention clip when said ring and said clip are assembled with said fuel injector, said ring operative to distribute about said clip a pressure load applied to said fuel injector.

28. An apparatus in accordance with claim 27 wherein said load shoulder includes an upper conically-shaped portion and a lower conically-shaped portion, said lower conically-shaped portion configured for engagement with said ring and said upper conically-shaped portion configured to engage the inner surface of said cup when said injector is inserted in said cup.

29. An apparatus in accordance with claim 27 wherein said ring comprises an elastically-deformable split-ring.

* * * * *